US012589786B2

(12) United States Patent
Chen et al.

(10) Patent No.: US 12,589,786 B2
(45) Date of Patent: Mar. 31, 2026

(54) METHOD FOR IMPROVING SHUNTING ROUTE SETTING OF CENTRALIZED TRAFFIC CONTROL SYSTEM, DEVICE AND MEDIUM

(71) Applicant: CASCO SIGNAL LTD., Shanghai (CN)

(72) Inventors: Fan Chen, Shanghai (CN); Baowei Tang, Shanghai (CN); Ruyue Wang, Shanghai (CN); Gang Wang, Shanghai (CN); Yuehua Zhai, Shanghai (CN); Zhenguo Feng, Shanghai (CN)

(73) Assignee: CASCO SIGNAL LTD., Shanghai (CN)

( * ) Notice: Subject to any disclaimer, the term of this patent is extended or adjusted under 35 U.S.C. 154(b) by 35 days.

(21) Appl. No.: 18/717,300

(22) PCT Filed: Nov. 29, 2022

(86) PCT No.: PCT/CN2022/134996
§ 371 (c)(1),
(2) Date: Jun. 6, 2024

(87) PCT Pub. No.: WO2023/124705
PCT Pub. Date: Jul. 6, 2023

(65) Prior Publication Data

US 2025/0033681 A1 Jan. 30, 2025

(30) Foreign Application Priority Data

Dec. 30, 2021 (CN) ..... 202111644540.X

(51) Int. Cl.
*B61L 1/00* (2006.01)
*B61L 17/02* (2006.01)
*B61L 27/16* (2022.01)

(52) U.S. Cl.
CPC ..... *B61L 27/16* (2022.01); *B61L 17/023* (2013.01)

(58) Field of Classification Search
CPC ..... B61L 27/16; B61L 17/023; B61L 25/08; B61L 27/14; B61L 27/00; B61L 1/00; G06Q 10/047
(Continued)

(56) References Cited

U.S. PATENT DOCUMENTS

2021/0334420 A1* 10/2021 Du ..... G06F 30/10

FOREIGN PATENT DOCUMENTS

CN 102328673 A 1/2012
CN 106553664 A 4/2017
(Continued)

OTHER PUBLICATIONS

International Search Report (with English translation) and Written Opinion issued in PCT/CN2022/134996, dated Jan. 28, 2023, 10 pages provided.

*Primary Examiner* — Shardul D Patel
(74) *Attorney, Agent, or Firm* — HSML P.C.

(57) ABSTRACT

A method is provided for shunting route setting of a centralized traffic control system. The method includes S1, acquiring a shunting operation plan from an interface of a SMIS and generating a shunting route sequence, by a centralized traffic control system; S2, adding an operation direction, a location identifier of a shunter, a current control mode of the shunter and a description of a next route based on an original shunter number of the centralized traffic control system; S3, configuring a manual setting mode and an automatic triggering mode for shunting route setting; S4, adding identifiers of the manual setting mode and the automatic triggering mode to shunter number display; and S5, in the manual setting mode, adding a shunting plan
(Continued)

constraint state and a free setting state to a shunting route setting logic of the centralized traffic control system.

15 Claims, 4 Drawing Sheets

(58) Field of Classification Search
USPC ..... 701/119
See application file for complete search history.

(56) References Cited

FOREIGN PATENT DOCUMENTS

| | | | |
|---|---|---|---|
| CN | 112572549 | A | 3/2021 |
| CN | 114394132 | A | 4/2022 |
| JP | H0672333 | A | 3/1994 |
| JP | 2007237936 | A | 9/2007 |

* cited by examiner

METHOD FOR IMPROVING SHUNTING ROUTE SETTING OF CENTRALIZED TRAFFIC CONTROL SYSTEM, DEVICE AND MEDIUM

BACKGROUND OF THE INVENTION

1. Technical Field

The invention relates to train signal control systems, in particular to a method for improving shunting route setting of a centralized traffic control system, a device and a medium.

2. Description of Related Art

At present, a centralized traffic control system realizes shunting route setting typically by clicking departure and destination buttons of shunting routes in a station map or by triggering a shunting route sequence which is automatically generated after the centralized traffic control system acquires a shunting operation plan from a system interface of a synthesized management information system (SMIS). These two route setting methods have the following disadvantages:

(1) Method for Setting Shunting Routes by Clicking Route Departure and Destination Buttons in the Station Map Advantages Shunting routes can be set visually and quickly, and attendants/signalmen can visually know the condition of a current station: the setting operation is the same as the operation on an interlocking terminal and is simple:

Drawbacks

Because there are a large number of buttons in the station map, setting errors may be caused easily due to mis-click of the buttons; routes cannot be previewed:

(2) Method for Setting Shunting Route by Triggering the Shunting Route Sequence

Advantages

Shunting routes are set according to the shunting operation plan, such that safety control measures can be taken, and mis-settings are avoided: routes can be previewed and confirmed before being set finally:

Disadvantages

This method is not visual enough, routes are set in the route sequence, and the actual station state cannot be known in real time: the route sequence displays departure and destination buttons in the form of a table, and the route form needs to be imagined; in case of multiple shunters, the shunting operation sheet needs to be switched frequently, compromising setting efficiency.

It can be found, by analyzing the above two setting methods, that existing shunting route setting methods for the centralized traffic control system have both advantages and disadvantages. Hence, how to overcome corresponding disadvantages becomes a technical issue to be addressed.

BRIEF SUMMARY OF THE INVENTION

The objective of the invention is to overcome the above-mentioned disadvantages in the prior art by providing a method for improving shunting route setting of a centralized traffic control system, a device and a medium so as to improve the shunting route setting safety and efficiency of the centralized traffic control system.

The objective of the invention can be fulfilled by the following technical solution:

In a first aspect, the invention provides a method for improving shunting route setting of a centralized traffic control system, comprising the following steps:

- S1, acquiring a shunting operation plan from an interface of a SMIS and generating a shunting route sequence, by a centralized traffic control system;
- S2, adding an operation direction, a location identifier of a shunter, a current control mode of the shunter and a description of a next route based on an original shunter number of the centralized traffic control system;
- S3, configuring a manual setting mode and an automatic triggering mode for shunting route setting;
- S4, adding identifiers of the manual setting mode and the automatic triggering mode in shunter number display;
- S5, in the manual setting mode, adding a shunting plan constraint state and a free setting state to a shunting route setting logic of the centralized traffic control system;
- S6, displaying the operation direction, which is determined according to a direction of a route set in front, on the shunter number;
- S7, displaying the location identifier of the shunter, which is automatically generated based on system determination according to a direction of the shunter when shunter enters a coupling state, above the shunter number;
- S8, displaying the description of the next route, which is automatically generated according to a next route in the shunting operation plan, over the shunter number;
- S9, optimizing an existing route preview and display effect;
- S10, designing that a menu pops up to perform corresponding functional operations in case of a right click on the shunter number;
- S11, designing that the shunter is in the shunting plan constraint state when the description of the next route is displayed above the shunter number, and otherwise, the shunter is in the free setting state; and
- S12, in the manual setting mode and the shunting plan constraint state, performing, by an attendant or signalman, route changing by means of the right-click menu of the shunter number, and selecting a corresponding alternate route as a route to be set.

As a preferred technical solution, the description of the next route in S2 comprises departure and destination buttons and a departure-to-destination section.

As a preferred technical solution, in S2, the centralized traffic control system has an STP interface for displaying speed and distance information.

As a preferred technical solution, in S3, the shunter is specified, by the attendant or signalman, to be in the manual setting mode or the automatic triggering mode by means of the centralized traffic control system.

As a preferred technical solution, the identifiers in S4 are specifically: "yellow" indicating the manual setting mode and "green" indicating the automatic triggering mode.

As a preferred technical solution, in S5, in the shunting plan constraint state, the next route of the shunter needs to be set based on the shunting route sequence generated according to the shunting operation plan, otherwise, the route will not be set, and the shunter is also constrained by the shunting operation plan even when the route is manually set with buttons; and in the free setting state, the shunter is not constrained by the shunting operation plan, and the attendant or signalman is allowed to set shunting routes freely by clicking on buttons.

As a preferred technical solution, in S5, the shunting plan constraint state and the free setting state are manually selected; and in the automatic triggering mode, the shunter is definitely in the shunting plan constraint state.

As a preferred technical solution, in S6, in a case where the system fails to accurately determine the operation direction, the operation direction is set manually; and in S7, in a case where the system fails to accurately determine a location of the shunter, the location identifier is set manually.

As a preferred technical solution, in S8, if the description of the next route is present, it indicates that the shunter is in the shunting plan constraint state: or, if the description of the next route in S8 is absent, it indicates that the shunter is in the free setting state.

As a preferred technical solution, S9 specifically comprises: changing previous route previews displayed by a pop-up window into direct real-time display in a station map, and when a cursor is moved to the shunter number, displaying in real time a previewed route according to a next shunting route to be set; and when the cursor is moved away from the shunter number, hiding the previewed route.

As a preferred technical solution, the corresponding functional operations in S10 comprise route triggering, route cancelling, route changing, mode selection, state selection, shunter number modification, shunter location setting, and operation direction setting.

As a preferred technical solution, an effect realized by performing route triggering and canceling by means of the right-click menu of the shunter number is the same as an effect realized by previous triggering according to a route sequence table.

As a preferred technical solution, in S12, the alternate route is selected by:

automatically listing, by the system, optional alternate routes to be selected by users according to an actual interlocking relation of a station; if a default basic route of the system fails to meet setting conditions, automatically selecting, by the system, an alternate with a high priority as a route to be set later according to priorities of the alternate routes; and when the basic route meets the setting conditions, selecting, by the system, the basic route as a next route to be set.

In a second aspect, the invention provides an electronic device, comprising a memory and a processor, wherein a computer program is stored in the memory, and when executing the computer program, the processor implements the method mentioned above.

In a third aspect, the invention provides a computer-readable storage medium having a computer program stored therein, wherein the method mentioned above is implemented when the computer program is executed.

Compared with the prior art, the invention has the following advantages:

1. In the invention, important information such as the current shunter number, operation direction, shunter location, the next route as planned and the control mode are visually displayed by the shunter number in the centralized traffic control system, such that users can directly know key information of the shunter, thus greatly improving efficiency.
2. In the invention, a shunting route can be directly triggered by means of the shunter number, which is basically the same as the original method for setting shunting routes with buttons in a station map, conforms to operation habits of users, and can be quickly mastered.
3. Because shunting routes need to be set in real time according to the actual condition of the station map, the route setting method provided by the invention allows users to set shunting routes conveniently according to the actual condition.
4. In the invention, shunting route setting is performed according to the shunting operation plan and is constrained by the plan, thus effectively avoiding setting errors and mis-settings.

DETAILED DESCRIPTION OF THE INVENTION

The technical solutions of the embodiments of the invention will be clearly and completely described below in conjunction with the accompanying drawings of the embodiments of the invention. Obviously, the embodiments in the following description are merely illustrative ones, and are not all possible ones of the invention. All other embodiments obtained by those ordinarily skilled in the art according to the following ones without creative labor should also fall within the protection scope of the invention.

Figure 1:
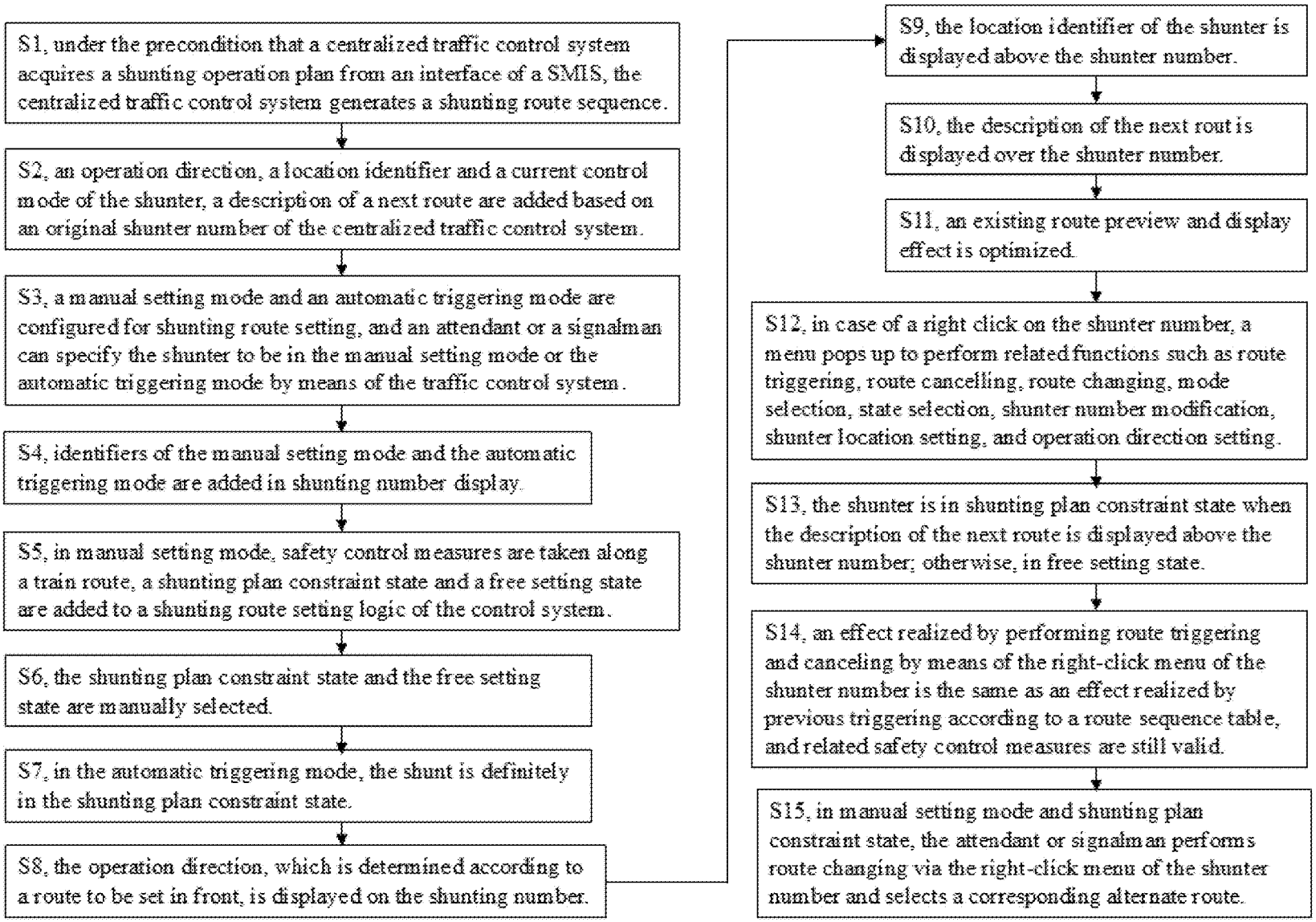
FIG. 1 is a flow diagram according to the invention.
Figure 2:
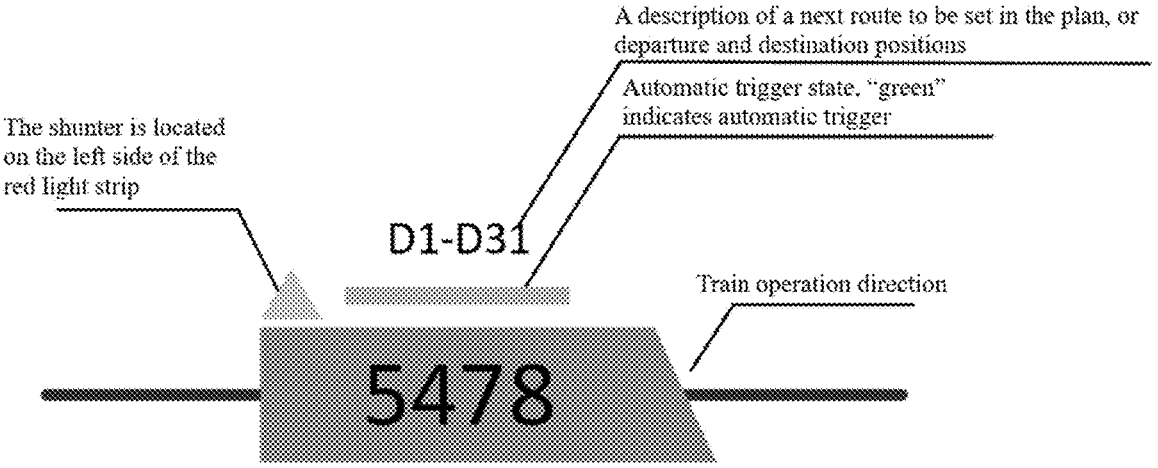
FIG. 2 is an example of shunter number display designed according to the invention (the route description is displayed by departure and destination buttons)
Figure 3:
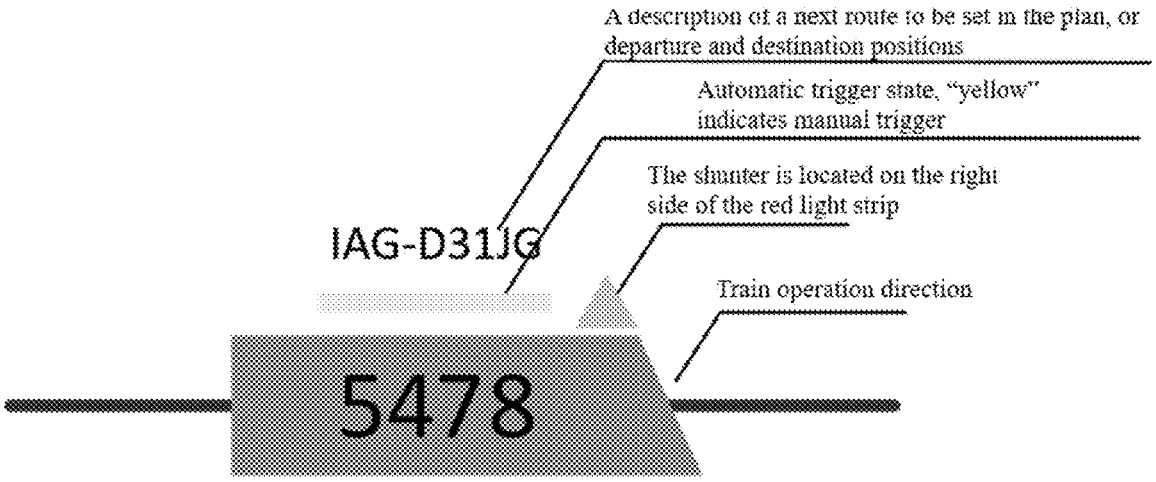
FIG. 3 is an example of shunter number display designed according to the invention (the route description is displayed by a departure-to-destination section)
Figure 4:
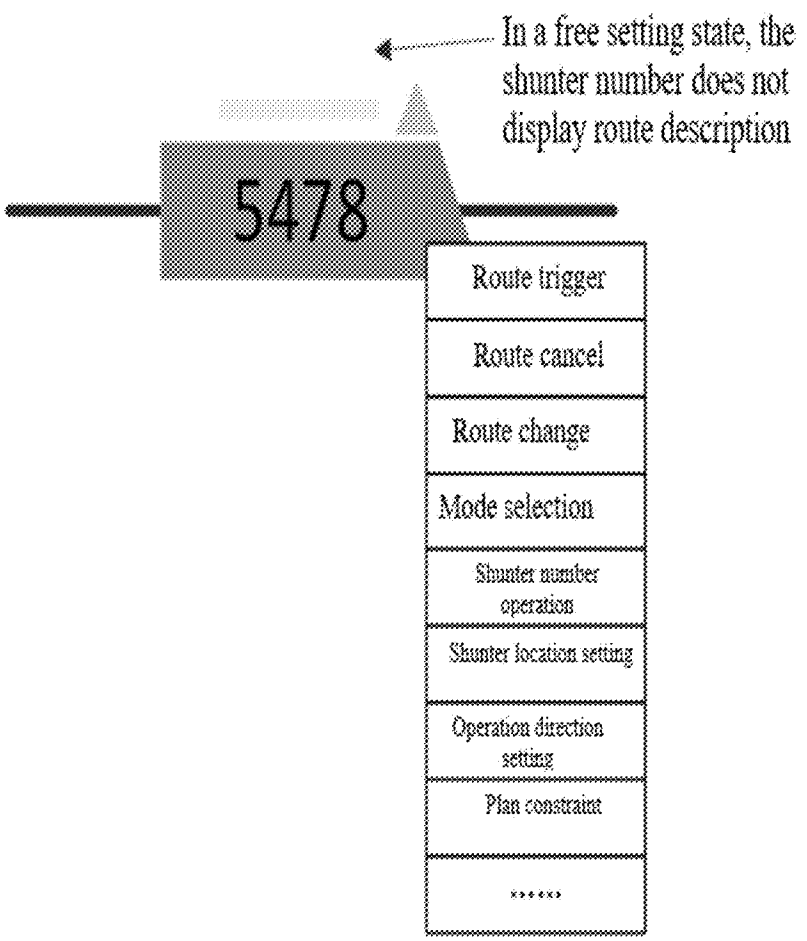
FIG. 4 is a schematic diagram of a right-click menu of a shunter number designed according to the invention.
Figure 4:
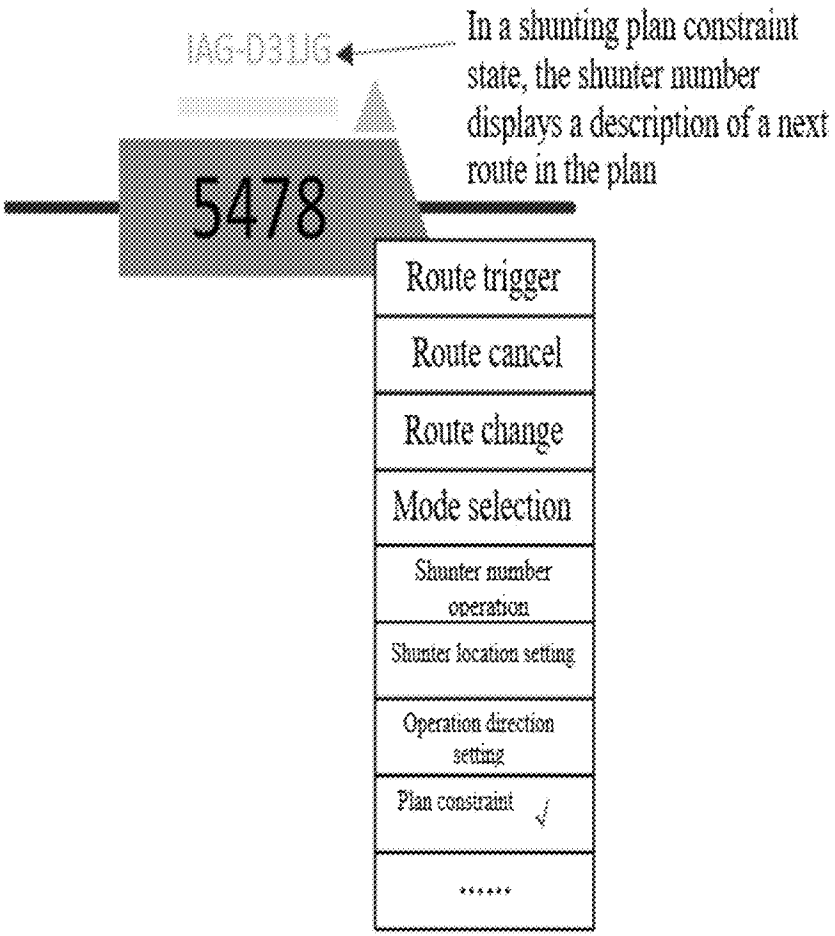
Figure 5:
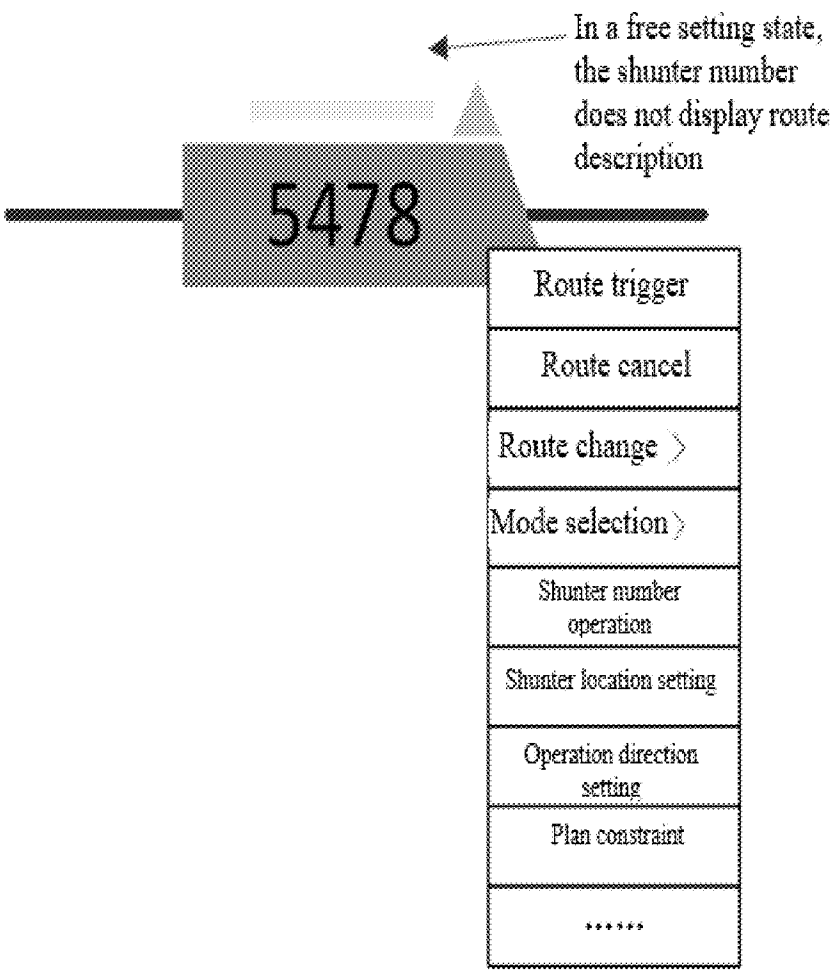
FIG. 5 is a schematic diagram of an example of route changing performed by means of the right-click menu of the shunter number designed according to the invention.
Figure 5:
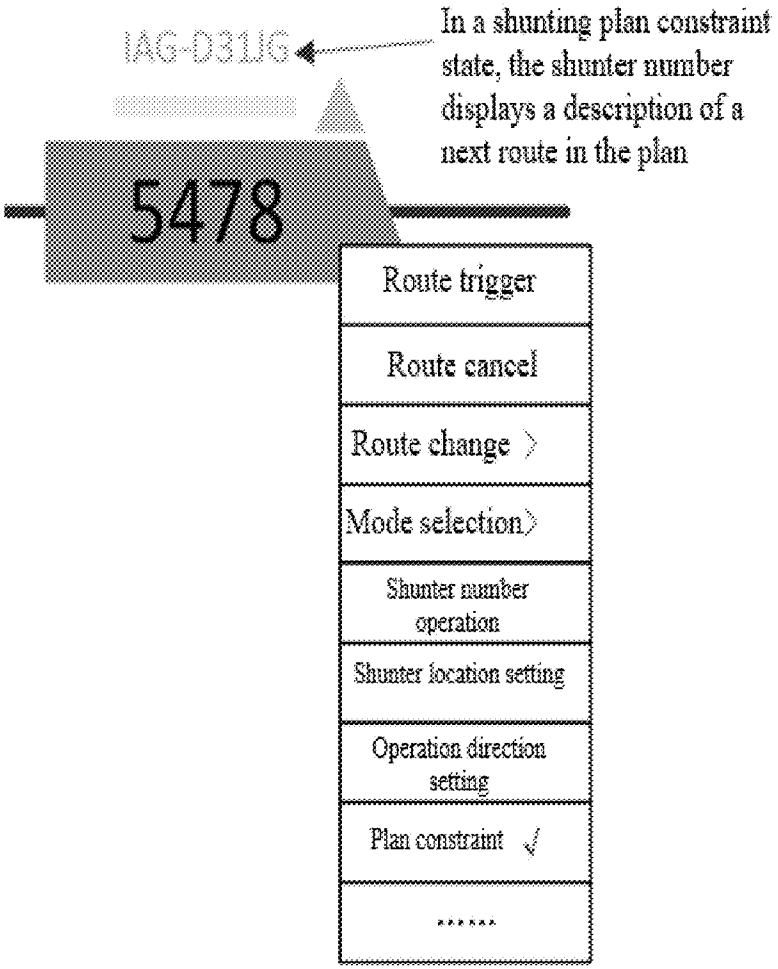

As shown in FIG. 1, the invention provides a method for improving shunting route setting of a centralized traffic control system, comprising the following steps:

S1, under the precondition that a centralized traffic control system acquires a shunting operation plan from an interface of a SMIS, the centralized traffic control system generates a shunting route sequence;

S2, an operation direction, a location identifier of a shunter (on the left or right side of a light strip), a current control mode of the shunter (automatic triggering or manual triggering), a description of a next route (departure and destination buttons or a departure-to-destination section) are added based on an original shunter number of the centralized traffic control system. The centralized traffic control system has an STP interface for displaying the speed, distance and other related information;

S3, a manual setting mode and an automatic triggering mode are configured for shunting route setting, and an attendant or a signalman can specify the shunter to be in the manual setting mode or the automatic triggering mode by means of the centralized traffic control system;

S4, identifiers of the manual setting mode and the automatic triggering mode are added in shunting number display, wherein "yellow" indicates the manual setting mode, and "green" indicates the automatic triggering mode;

S5, in the manual setting mode, safety control measures are taken along a train route, a shunting plan constraint state and a free setting state are added to a shunting route setting logic of the centralized traffic control system. In the shunting plan constraint state, the next route of the shunter needs to be set based on the shunting route sequence generated according to the shunting operation plan, otherwise, the route will not be set, and the shunter is also constrained by the shunting operation plan even when the route is manually set with buttons; and in the free setting state, the shunter is not constrained by the shunting operation plan, and the attendant or signalman is allowed to set shunting routes freely by clicking on buttons;

S6, the shunting plan constraint state and the free setting state are manually selected;

S7, in the automatic triggering mode, the shunt is definitely in the shunting plan constraint state;

S8, the operation direction, which is determined according to a route to be set in front, is displayed on the shunting number, wherein in a case where the system fails to accurately determine the operation direction, the operation direction is set manually;

S9, the location identifier of the shunter, which is automatically generated based on system determination according to a direction of the shunter when shunter enters a coupling state, is displayed above the shunter number, wherein in a case where the system fails to accurately determine the location of the shunter, the location identifier is set manually;

S10, the description of the next route, which is automatically generated according to a next route in the shunting operation plan, is displayed over the shunter number. A route description (departure and destination buttons) or a description of a departure-to-destination section is displayed as required by users. In the presence of the route description, it indicates that the shunter is in the shunting plan constraint state; and in the absence of the route description, it indicates that the shunter is in the free setting state. "Yellow" (or "white") is displayed in default, "green" is displayed after route setting, and at the end of the current route, a next route plan is displayed (a route description or a departure-to-destination section);

S11, an existing route preview and display effect is optimized: previous route previews displayed by a pop-up window are changed into direct real-time display in a station map, and when a cursor is moved to the shunter number, a previewed route is displayed in real time according to a next shunting route to be set: when the cursor is moved away from the shunter number, the previewed route disappears;

S12, it is designed that in case of a right click on the shunter number, a menu pops up to perform related functions such as route triggering, route cancelling, route changing, mode selection, state selection, shunter number modification, shunter location setting, and operation direction setting, thus improving operating efficiency;

S13, it is designed that the shunter is in the shunting plan constraint state when the description of the next route is displayed above the shunter number, and otherwise, the shunter is in the free setting state;

S14, an effect realized by performing route triggering and canceling by means of the right-click menu of the shunter number is the same as an effect realized by previous triggering according to a route sequence table, and related safety control measures are still valid; and S15, in the manual setting mode and the shunting plan constraint state, the attendant or signalman performs route changing by means of the right-click menu of the shunter number and selects a corresponding alternate route as a route to be set: the system automatically lists optional alternate routes to be selected by users according to an actual interlocking relation of a station; if a default basic route of the system fails to meet setting conditions, the system automatically selects an alternate with a high priority as a route to be set later according to priorities of the alternate routes; and when the basic route meets the setting conditions, the system selects the basic route as a next route to be set.

Specific Embodiment

The problems and steps of original setting methods are introduced below:

100, shunting routes are set directly by clicking on departure and destination buttons in a station map; however, mis-settings may be caused easily due to mis-click of the buttons, and no preview is formed;

S101, when routes are triggered by means of a route sequence, the state of the station map cannot be visually observed; and in case of multiple shunters, the shunting operation sheet needs to be switched frequently, leading to low setting efficiency and mis-settings.

First referring to FIG. 2-FIG. 5, the invention improves and innovates the route setting operation to improve the visuality, safety and convenience of shunting route setting. The method specifically comprises the following steps:

102, by adopting the method, an attendant or signalman can quickly know important information such as the current shunter number, operation direction, shunter location, the next route as planned and the control mode by means of the shunter number in a station map, and the information is visual and clear;

Step 103, by adopting the method, the attendant and signalman can perform route triggering (based on a route sequence formed according to a routing operation plan), route cancelling, route selection and changing, shunter number modification, shunter operation direction setting, shunter location setting, control mode and state selection and other functions directly by right clicking on the shunter number, such that operation is convenient, and efficiency is high:

The route setting process is improved specifically as follows:

Step 104, after receiving the shunting operation plan from a SMIS, the centralized traffic control system automatically generates a shunting route sequence;

Step 105, according to a shunter number input by the attendant, a relationship between the shunter number and the shunting route sequence is formed; in a shunting plan constraint state, a description of a route to be set later is displayed above the shunt number according to the shunting route sequence;

Step 106, when the attendant (or signalman) moves a cursor onto the shunter number, the system displays in real time a previewed route in the station map according to a next route in the shunting route sequence, such that the route can be checked by the attendant (or signalman);

Step 107, after confirming that the previewed route is correct, the attendant (or signalman) directly performs a right click on the shunter number to select "route trigger" by, and then the centralized traffic control system will complete route setting;

Step 108, if the route needs to be cancelled, the attendant (or signalman) just needs to perform a right click on the shunter number again to select "route cancel", such that the route is cancelled;

Step 109, if the route needs to be changed, the attendant (or signalman) just needs to perform a right click on the shunter number again to select "route change" and select a corresponding route description in a submenu, such that the route is changed;

Step 110, in the interface of the station map of the centralized traffic control system, the shunter number always follows a red light strip on the shunter unless the shunter number is manually eliminated or enters a non-centralized zone.

Embodiments of the method are introduced above, and the technical solution of the invention will be further described below with reference to embodiments of an electronic device and a storage medium.

An electronic device provided by the invention comprises a central processing unit (CPU), which can perform various appropriate actions and processing according to computer program instructions stored in a read only memory (ROM) or computer program instructions loaded into a random access memory (RAM) from a storage unit. Various programs and data required for operations of the device can also be stored in the RAM. The CPU, ROM and RAM are connected by means of a bus. An input/output (I/O) interface is also connected to the bus.

Multiple components in the device are connected to the I/O interface, including an input unit such as a keyboard or a mouse; an output unit such as various displays or speakers: a storage unit such as a magnetic disk or a compact disc; and a communication unit such as a network card, a modem or a wireless communication transceiver. The communication unit allows the device to exchange information/data with other devices by means of, for example, computer networks based on the internet and/or various telecommunication networks.

The processing unit performs the steps and processing described above, such as the method S1-S15. For example, in some embodiments, the method S1-S15 can be implemented as a computer software program, which is tangibly stored in a machine-readable medium such as the storage unit. In some other embodiments, the computer program may be partially or entirely loaded and/or installed on the device by means of the ROM and/or the communication unit. When the computer program is loaded into the RAM and executed by the CPU, one or more of the steps of the method S1-S15 described above can be performed. Alternatively, in other embodiments, the CPU can be configured to implement the method S1-S15 in any other appropriate ways (such as, by means of firmware).

At least part of the functions described above can be performed by one or more hardware logic components. For example, non-restrictively, illustrative hardware logic components that can be used include: a field programmable gate array (FPGA), an application-specific integrated circuit (ASIC), an application-specific standard product (ASSP), a system on chip (SOC), a complex programmable logic device (CPLD), and the like.

Program codes for implementing the method of the invention may be written in one programming language or any combination of multiple programming languages. These program codes can be provided to a processor or a controller of a general-purpose computer, a special-purpose computer or other programmable data processing devices, such that when the program codes are executed by the processor or controller, the functions/operations specified in the flow diagram and/or block diagram are performed. The program codes may be entirely executed on a machine, partially executed on a machine, partially executed on a machine as an independent software package and partially executed on a remote machine, or entirely executed on a remote machine or server.

In the context of the invention, the machine-readable medium may be a tangible medium, and may comprise or store a program, which is used by or in conjunction with an instruction execution system, apparatus or device. The machine-readable medium may be a machine-readable signal medium or a machine-readable storage medium. The machine-readable medium may comprise, but is not limited to, electronic, magnetic, optical, electromagnetic, infrared or semiconductor systems, apparatuses or devices, or any suitable combinations thereof. More specific examples of the machine-readable storage medium comprise an electrical connection based on one or more wires, a portable computer disk, a hard disk, a random access memory (RAM), a read only memory (ROM), an erasable programmable read only memory (EPROM or flash memory), an optical fiber, a portable compact disc read only memory (CD-ROM), an optical storage device, a magnetic storage device, or any combinations thereof.

The above embodiments are merely specific ones of the invention, and the protection scope of the invention is not limited to the above embodiments. Any skilled in the art can easily think of various equivalent modifications or substitutions within the technical scope disclosed by the invention, and all these equivalent modifications or substitutions should fall within the protection scope of the invention. Therefore, the protection scope of the invention should be subject to the protection scope of the claims.

What is claimed is:

1. A method for improving shunting route setting of a centralized traffic control system, comprising the following steps:

S1, acquiring a shunting operation plan from an interface of a synthesized management information system (SMIS) and generating a shunting route sequence, by a centralized traffic control system;

S2, adding an operation direction, a location identifier of a shunter, a current control mode of the shunter and a description of a next route based on an original shunter number of the centralized traffic control system;

S3, configuring a manual setting mode and an automatic triggering mode for shunting route setting;

S4, adding identifiers of the manual setting mode and the automatic triggering mode in shunter number display;

S5, in the manual setting mode, adding a shunting plan constraint state and a free setting state to a shunting route setting logic of the centralized traffic control system;

S6, displaying the operation direction, which is determined according to a direction of a route set in front, on the shunter number;

S7, displaying the location identifier of the shunter, which is automatically generated based on system determination according to a direction of the shunter when the shunter enters a coupling state, above the shunter number;

S8, displaying the description of the next route, which is automatically generated according to a next route in the shunting operation plan, over the shunter number;

S9, optimizing an existing route preview and display effect;

S10, designing that a menu pops up to perform corresponding functional operations in case of a right click on the shunter number;

S11, designing that the shunter is in the shunting plan constraint state when the description of the next route is displayed above the shunter number, and otherwise, the shunter is in the free setting state; and S12, in the manual setting mode and the shunting plan constraint state, performing, by an attendant or signalman, route changing by means of the right-click menu of the shunter number, and selecting a corresponding alternate route as a route to be set.

2. The method for improving shunting route setting of a centralized traffic control system according to claim 1, wherein the description of the next route in S2 comprises departure and destination buttons and a departure-to-destination section.

3. The method for improving shunting route setting of a centralized traffic control system according to claim 1, wherein in S2, the centralized traffic control system has a Spanning Tree Protocol (STP) interface for displaying speed and distance information.

4. The method for improving shunting route setting of a centralized traffic control system according to claim 1, wherein in S3, the shunter is specified, by the attendant or signalman, to be in the manual setting mode or the automatic triggering mode by means of the centralized traffic control system.

5. The method for improving shunting route setting of a centralized traffic control system according to claim 1, wherein the identifiers in S4 are specifically: "yellow" indicating the manual setting mode and "green" indicating the automatic triggering mode.

6. The method for improving shunting route setting of a centralized traffic control system according to claim 1, wherein in S5, in the shunting plan constraint state, the next route of the shunter needs to be set based on the shunting route sequence generated according to the shunting operation plan, otherwise, the route will not be set, and the shunter is also constrained by the shunting operation plan even when the route is manually set with buttons; and in the free setting state, the shunter is not constrained by the shunting operation plan, and the attendant or signalman is allowed to set shunting routes freely by clicking on buttons.

7. The method for improving shunting route setting of a centralized traffic control system according to claim 1, wherein in S5, the shunting plan constraint state and the free setting state are manually selected; and in the automatic triggering mode, the shunter is definitely in the shunting plan constraint state.

8. The method for improving shunting route setting of a centralized traffic control system according to claim 1, wherein in S6, in a case where the system fails to accurately determine the operation direction, the operation direction is set manually; and in S7, in a case where the system fails to accurately determine a location of the shunter, the location identifier is set manually.

9. The method for improving shunting route setting of a centralized traffic control system according to claim 1, wherein in S8, if the description of the next route is present, it indicates that the shunter is in the shunting plan constraint state; or, if the description of the next route in S8 is absent, it indicates that the shunter is in the free setting state.

10. The method for improving shunting route setting of a centralized traffic control system according to claim 1, wherein S9 specifically comprises: changing previous route previews displayed by a pop-up window into direct real-time display in a station map, and when a cursor is moved to the shunter number, displaying in real time a previewed route according to a next shunting route to be set; and when the cursor is moved away from the shunter number, hiding the previewed route.

11. The method for improving shunting route setting of a centralized traffic control system according to claim 1, wherein the corresponding functional operations in S10 comprise route triggering, route cancelling, route changing, mode selection, state selection, shunter number modification, shunter location setting, and operation direction setting.

12. The method for improving shunting route setting of a centralized traffic control system according to claim 11, wherein an effect realized by performing route triggering and canceling by means of the right-click menu of the shunter number is the same as an effect realized by previous triggering according to a route sequence table.

13. The method for improving shunting route setting of a centralized traffic control system according to claim 1, wherein in S12, the alternate route is selected by:

automatically listing, by the system, optional alternate routes to be selected by users according to an actual interlocking relation of a station; if a default basic route of the system fails to meet setting conditions, automatically selecting, by the system, an alternate with a high priority as a route to be set later according to priorities of the alternate routes; and when the basic route meets the setting conditions, selecting, by the system, the basic route as a next route to be set.

14. An electronic device, comprising a memory and a processor, a computer program being stored in the memory, wherein the method according to claim 1 is implemented when the processor executes the computer program.

15. A non-transitory computer-readable storage medium, having a computer program stored therein, wherein the method according to claim 1 is implemented when the computer program is executed by a processor.

* * * * *